US010468823B2

(12) United States Patent
Hsu et al.

(10) Patent No.: US 10,468,823 B2
(45) Date of Patent: Nov. 5, 2019

(54) ELECTRICAL CONNECTOR HAVING IMPROVED CONTACTS STRUCTURE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Chun-Hsiung Hsu, New Taipei (TW); Kuei-Chung Tsai, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/171,391

(22) Filed: Oct. 26, 2018

(65) Prior Publication Data

US 2019/0165518 A1 May 30, 2019

(30) Foreign Application Priority Data

Oct. 26, 2017 (CN) ..... 2017 1 1017265

(51) Int. Cl.

| | |
|---|---|
| ***H01R 13/6471*** | (2011.01) |
| ***H01R 13/6477*** | (2011.01) |
| ***H01R 13/502*** | (2006.01) |
| ***H01R 13/26*** | (2006.01) |
| *H01R 107/00* | (2006.01) |

(Continued)

(52) U.S. Cl.

CPC ..... *H01R 13/6471* (2013.01); *H01R 13/26* (2013.01); *H01R 13/502* (2013.01); *H01R 13/6477* (2013.01); *H01R 13/6585* (2013.01); *H01R 24/60* (2013.01); *H01R 2107/00* (2013.01)

(58) Field of Classification Search

CPC ..... H01R 13/6471; H01R 13/502; H01R 13/6477; H01R 13/647126

See application file for complete search history.

(56) References Cited

U.S. PATENT DOCUMENTS

| | | | | |
|---|---|---|---|---|
| 4,264,114 A * | 4/1981 | Chandler | ..... | H01R 12/724 439/62 |
| 6,036,506 A * | 3/2000 | Korsunsky | ..... | H01R 13/658 439/79 |
| 7,798,820 B2 | 9/2010 | Hong | | |

(Continued)

*Primary Examiner* — Briggitte R. Hammond

(74) *Attorney, Agent, or Firm* — Wei Te Chung; Ming Cheih Chang

(57) ABSTRACT

An electrical connector (100) includes an insulative housing (1), and a number of contacts received therein. The contacts include a pair of first and second grounding contacts (212, 222), and a pair of first and second signal contacts (211, 221). Each of the first signal and grounding contacts includes a first contact portion (213), a first mounting portion (214), a first horizontal portion (215), and a first connecting portion (216). Each of the second signal and grounding contacts includes a second contact portion (223), a second mounting portion (224), and a second horizontal portion (225). A first distance (d1) between the first connecting portion and the second mounting portion is greater than a second distance (d2) between the first and second horizontal portions, and is also greater than a third distance (d3) between the first and second mounting portions.

17 Claims, 19 Drawing Sheets

(51) Int. Cl.
*H01R 13/6585* (2011.01)
*H01R 24/60* (2011.01)

(56) References Cited

U.S. PATENT DOCUMENTS

| | | | | |
|---|---|---|---|---|
| 7,862,344 | B2 * | 1/2011 | Morgan | H01R 13/6467 439/108 |
| 8,353,707 | B2 * | 1/2013 | Wang | H01R 13/6658 439/60 |
| 8,506,333 | B2 | 8/2013 | Wang et al. | |
| 8,727,793 | B2 | 5/2014 | Cafiero et al. | |
| 8,858,237 | B2 | 10/2014 | Hsu et al. | |
| 9,083,130 | B2 | 7/2015 | Casher et al. | |
| 9,246,251 | B2 * | 1/2016 | Regnier | H01R 9/2408 |
| 9,413,112 | B2 * | 8/2016 | Helster | H01R 13/6467 |
| 9,455,530 | B2 * | 9/2016 | Patel | H01R 13/652 |
| 9,461,423 | B2 * | 10/2016 | Tsai | H01R 24/60 |
| 9,509,100 | B2 * | 11/2016 | Phillips | H01R 13/6587 |
| 10,141,676 | B2 * | 11/2018 | Astbury | H01R 12/716 |
| 2006/0014438 | A1 * | 1/2006 | Regnier | H01R 13/41 439/637 |
| 2012/0322313 | A1 * | 12/2012 | Hsu | H01R 12/724 439/629 |
| 2016/0211620 | A1 | 7/2016 | Sharf et al. | |

* cited by examiner

ELECTRICAL CONNECTOR HAVING IMPROVED CONTACTS STRUCTURE

BACKGROUND OF THE INVENTION

1. Field of the Invention

The present invention relates to an electrical connector, and more particularly to an electrical connector for transmitting high speed signal.

2. Description of Related Arts

U.S. Pat. No. 9,083,130 discloses an electrical connector comprising an insulative housing and a contact module received in the insulative housing. The contact module comprises two rows of contacts and two insulative members to fix the two rows of contacts, respectively. In this electrical connector, the characteristic impedance for transmitting high speed signal is tuned by adjusting parameters such as width and spacing of different portions of the contacts. However, in high speed signal transmission, there is also a need to adjust resonance.

Hence, an improved electrical connector is desired to offer advantages over the related art.

SUMMARY OF THE INVENTION

An object of the present invention is to provide an electrical connector to improve resonance and far end crosstalk performances in high-speed signal transmission.

To achieve the above-mentioned object, an electrical connector comprises an insulative housing; and a plurality of contacts received in the insulative housing, the contacts comprising a pair of first grounding contacts for transmitting grounding signal, a pair of first signal contacts for transmitting a differential signal, a pair of second grounding contacts for transmitting grounding signal, and a pair of second signal contacts for transmitting a differential signal, the first grounding contacts and the first signal contacts arranged in a first row along a first direction, the first signal contacts disposed between the first grounding contacts, the second grounding contacts and the second signal contacts arranged in a second row along the first direction, the second signal contacts disposed between the second grounding contacts, the second row is spaced apart from the first row along a second direction perpendicular to the first direction, each of the first signal contacts and the first grounding contacts comprising a first contact portion for being mated with a plug connector, a first mounting portion for being mounted on an outer printed circuit board, a first horizontal portion extending rearwardlly from the first mating portion, and a first connecting portion connected between the first horizontal portion and the first mounting portion, each of the second signal contacts and the second grounding contacts comprising a second contact portion for being mated with the plug connector, a second mounting portion for being mounted on the outer printed circuit board, and a second horizontal portion extending rearwardlly from the second mating portion; wherein a first distance between the first connecting portion and the second mounting portion is greater than a second distance between the first horizontal portion and the second horizontal portion, and is also greater than a third distance between the first mounting portion and the second mounting portion.

Since, according to the present invention, the first distance between the first connecting portion and the second mounting portion is greater than the second distance between the first horizontal portion and the second horizontal portion, and is also greater than the third distance between the first mounting portion and the second mounting portion, problem of resonance and far end crosstalk in high speed signal transmission may be suppressed.

DETAILED DESCRIPTION OF THE PREFERRED EMBODIMENT

Figure 1:
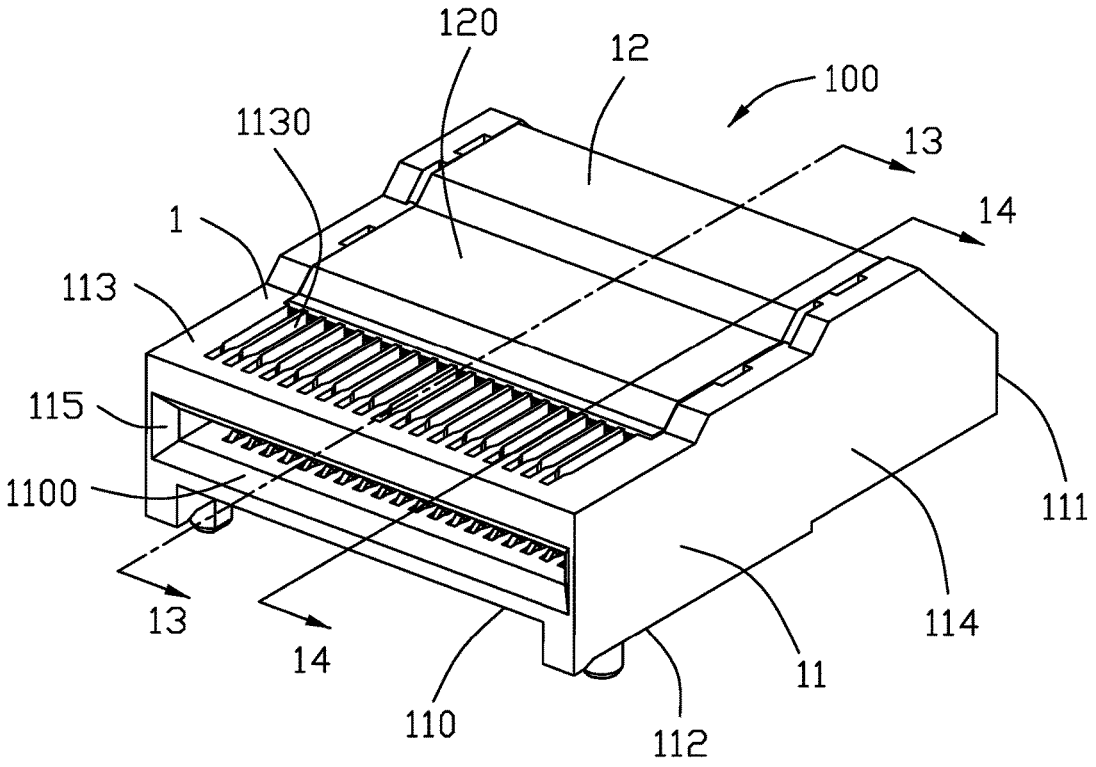
FIG. 1 is a perspective view of an electrical connector in accordance with present invention.
Figure 2:
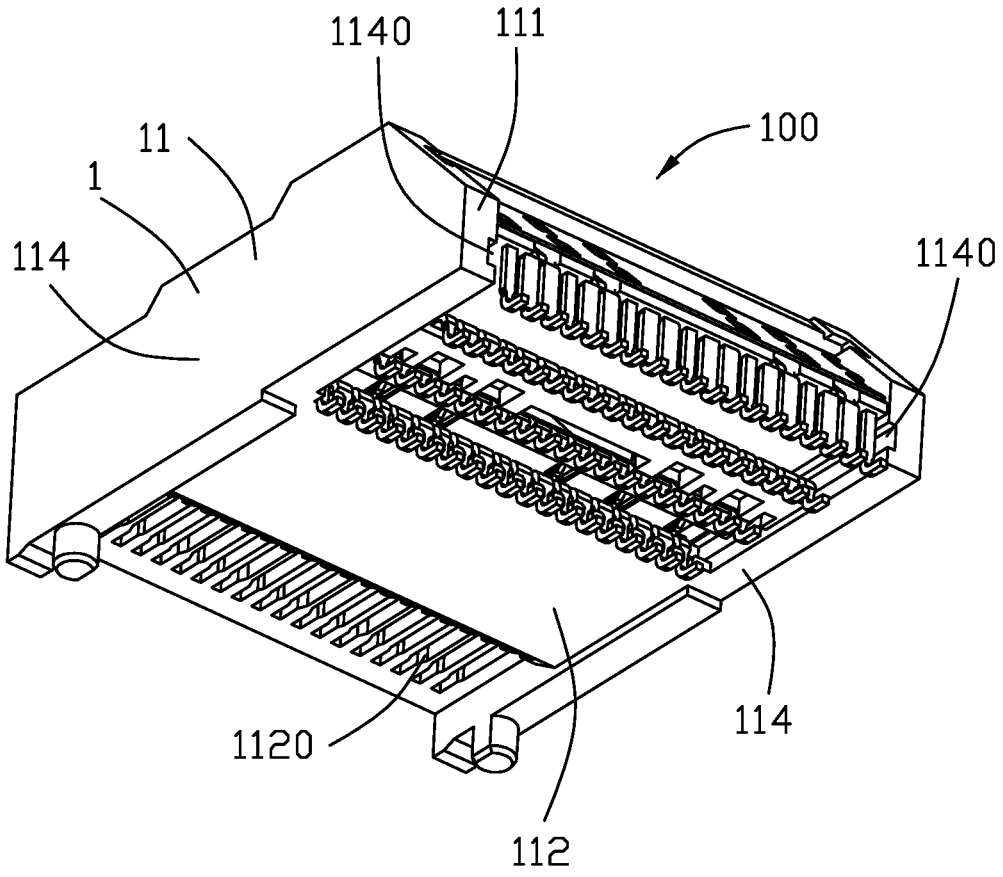
FIG. 2 is another perspective view of the electrical connector as shown in FIG. 1.
Figure 3:
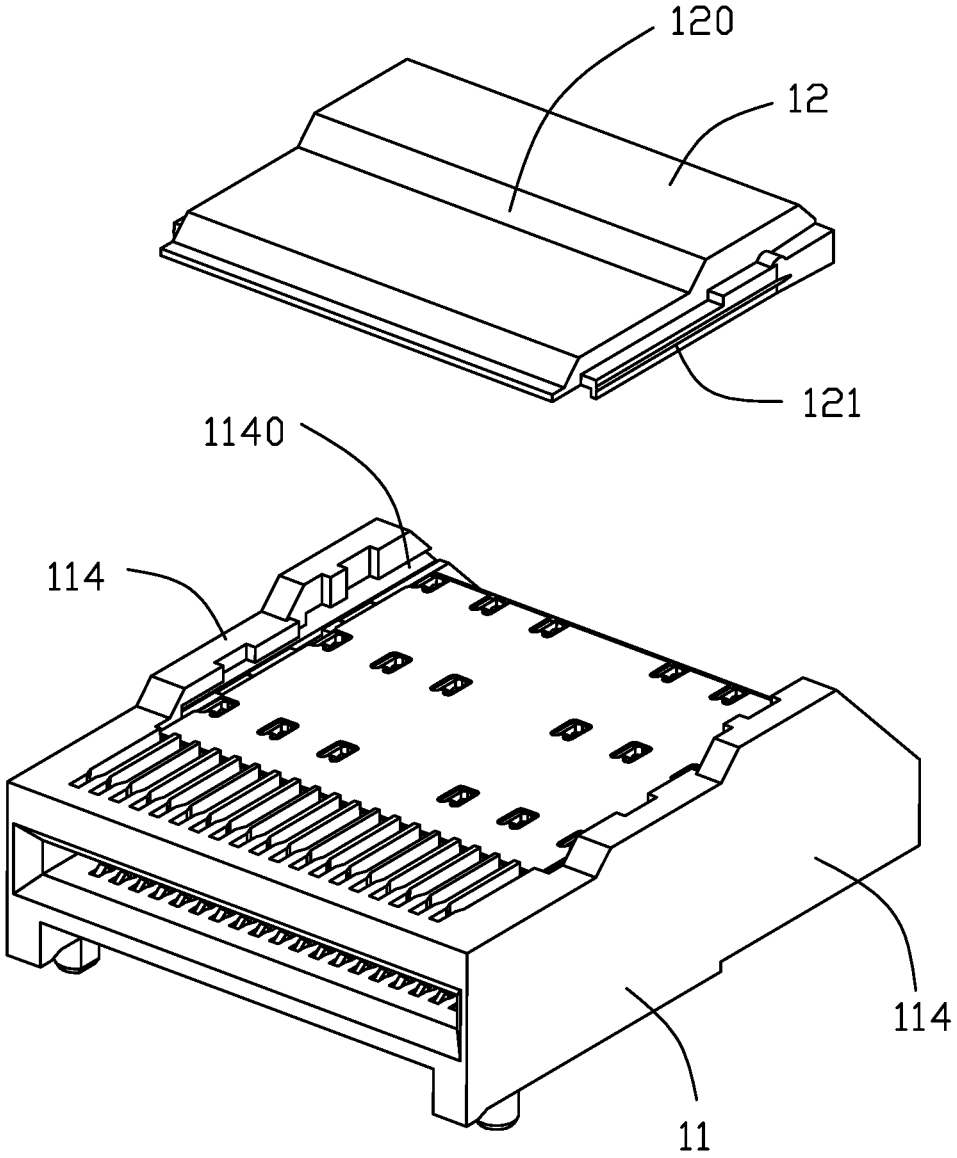
FIG. 3 is a part of exploded view of the electrical connector as shown in FIG. 1.
Figure 4:
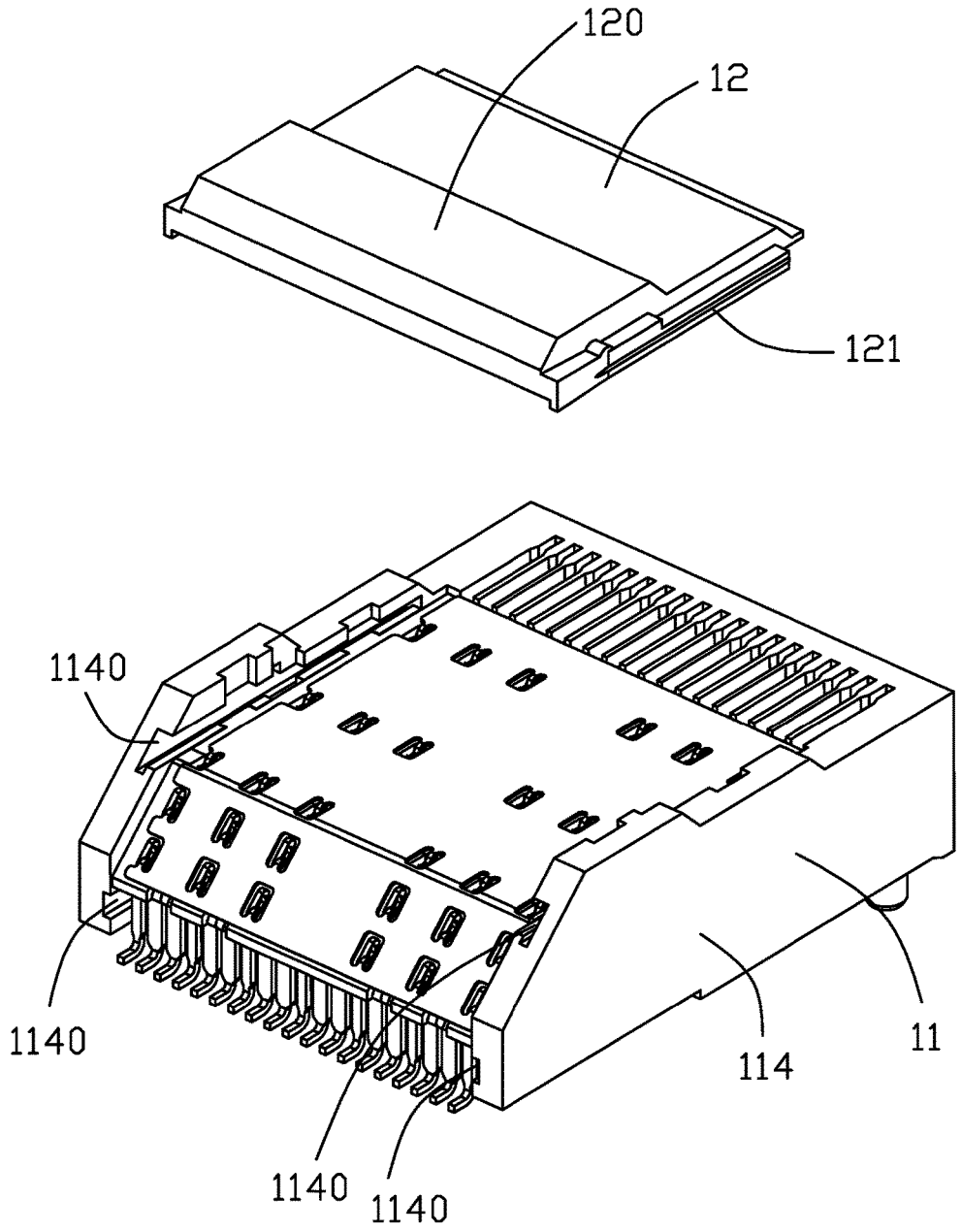
FIG. 4 is another part of exploded view of the electrical connector as shown in FIG. 3.
Figure 5:
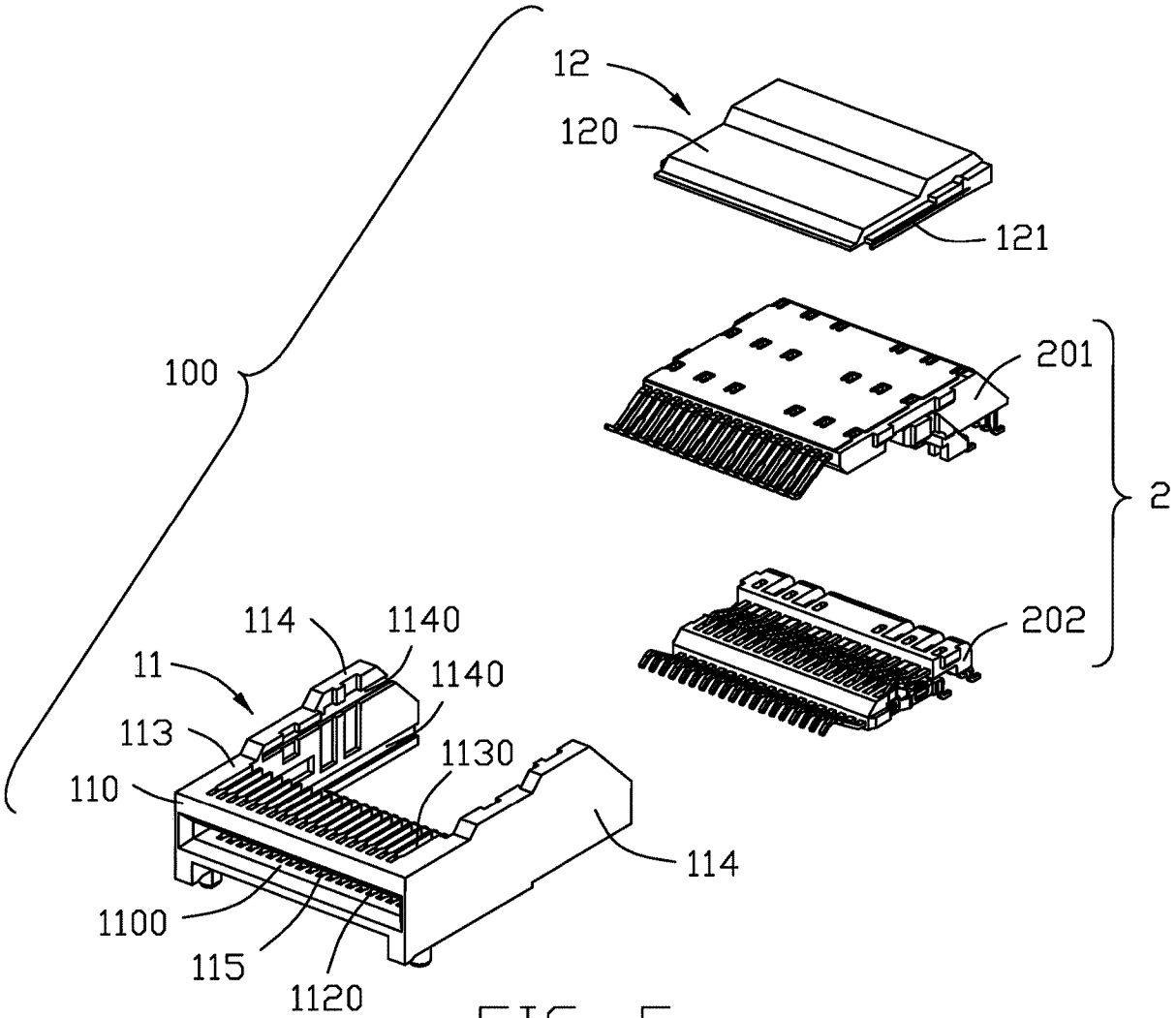
FIG. 5 is a further exploded view of the electrical connector as shown in FIG. 3.
Figure 6:
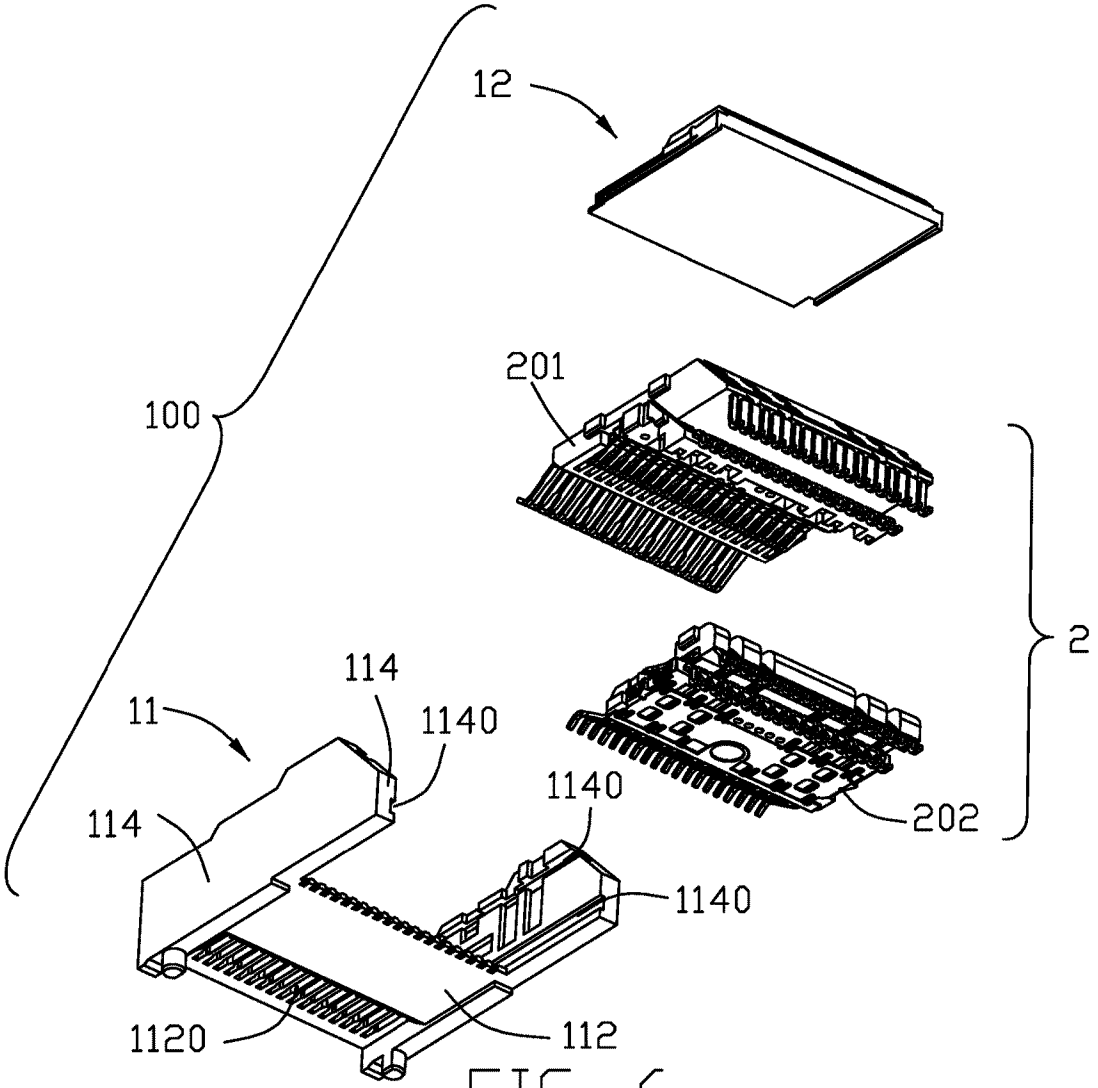
FIG. 6 is another further exploded view of the electrical connector as shown in FIG. 5.
Figure 7:
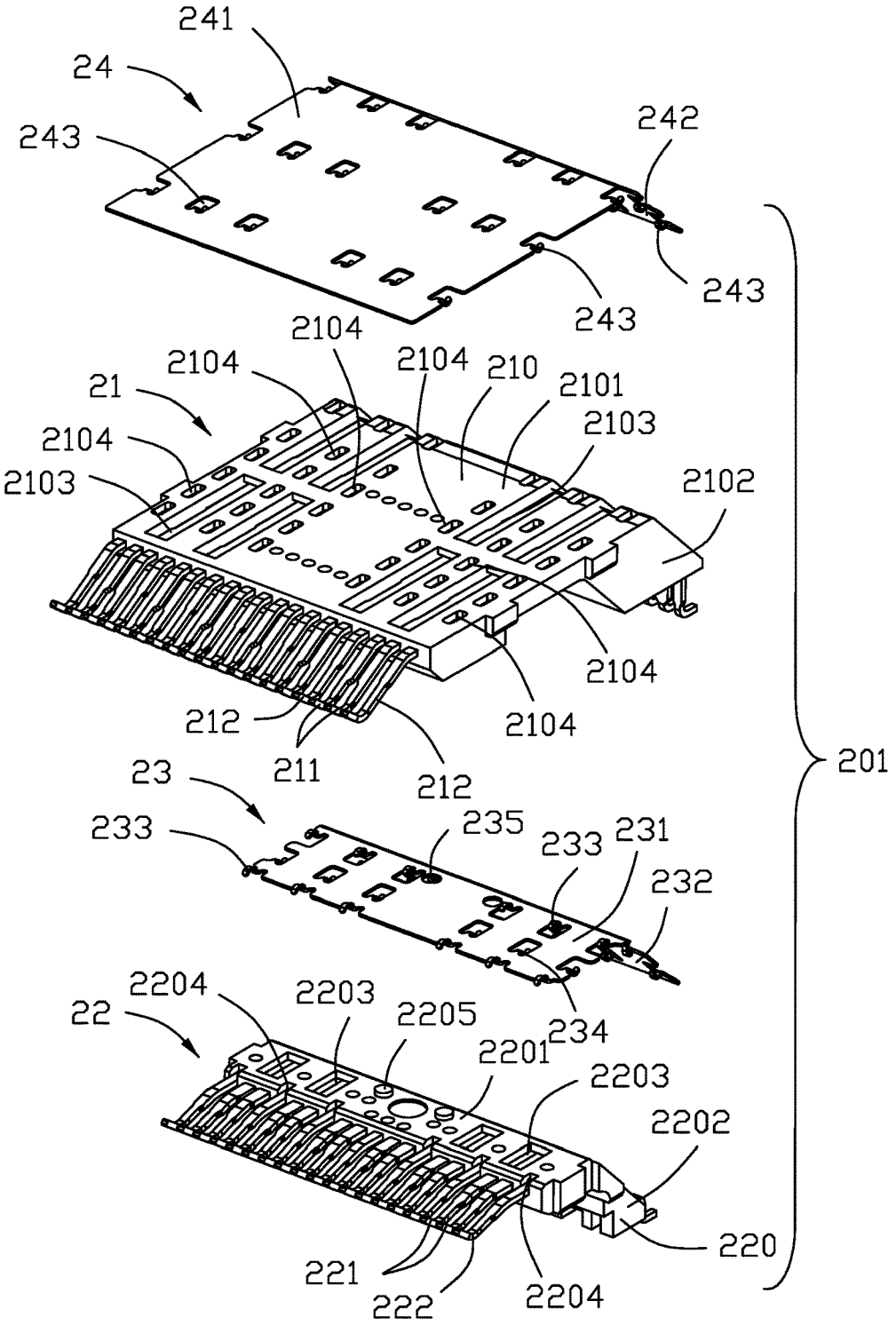
FIG. 7 is a further exploded view of an upper contact module of the electrical connector as shown in FIG. 6.
Figure 8:
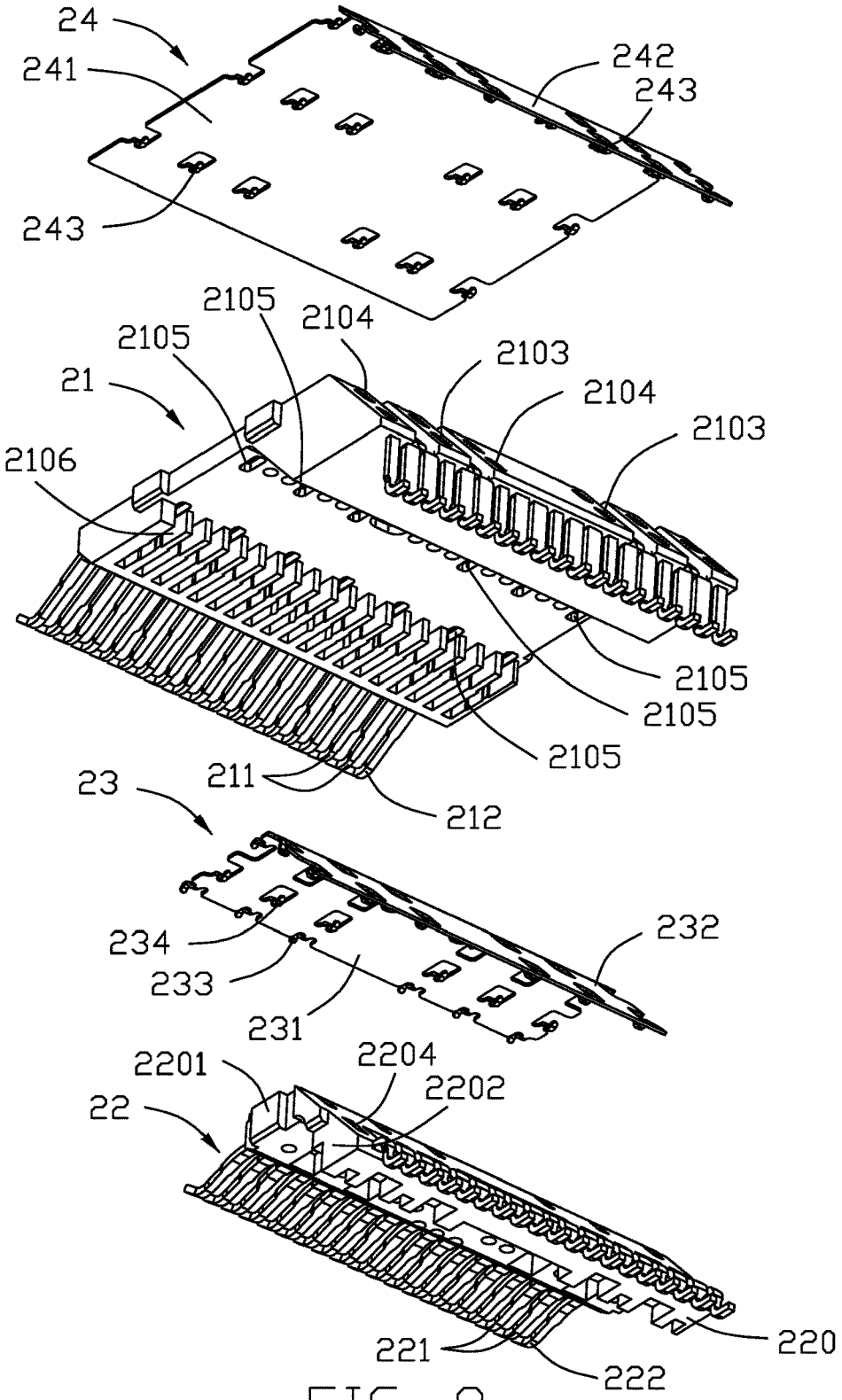
FIG. 8 is another further exploded view of the upper contact module of the electrical connector as shown in FIG. 7.
Figure 9:
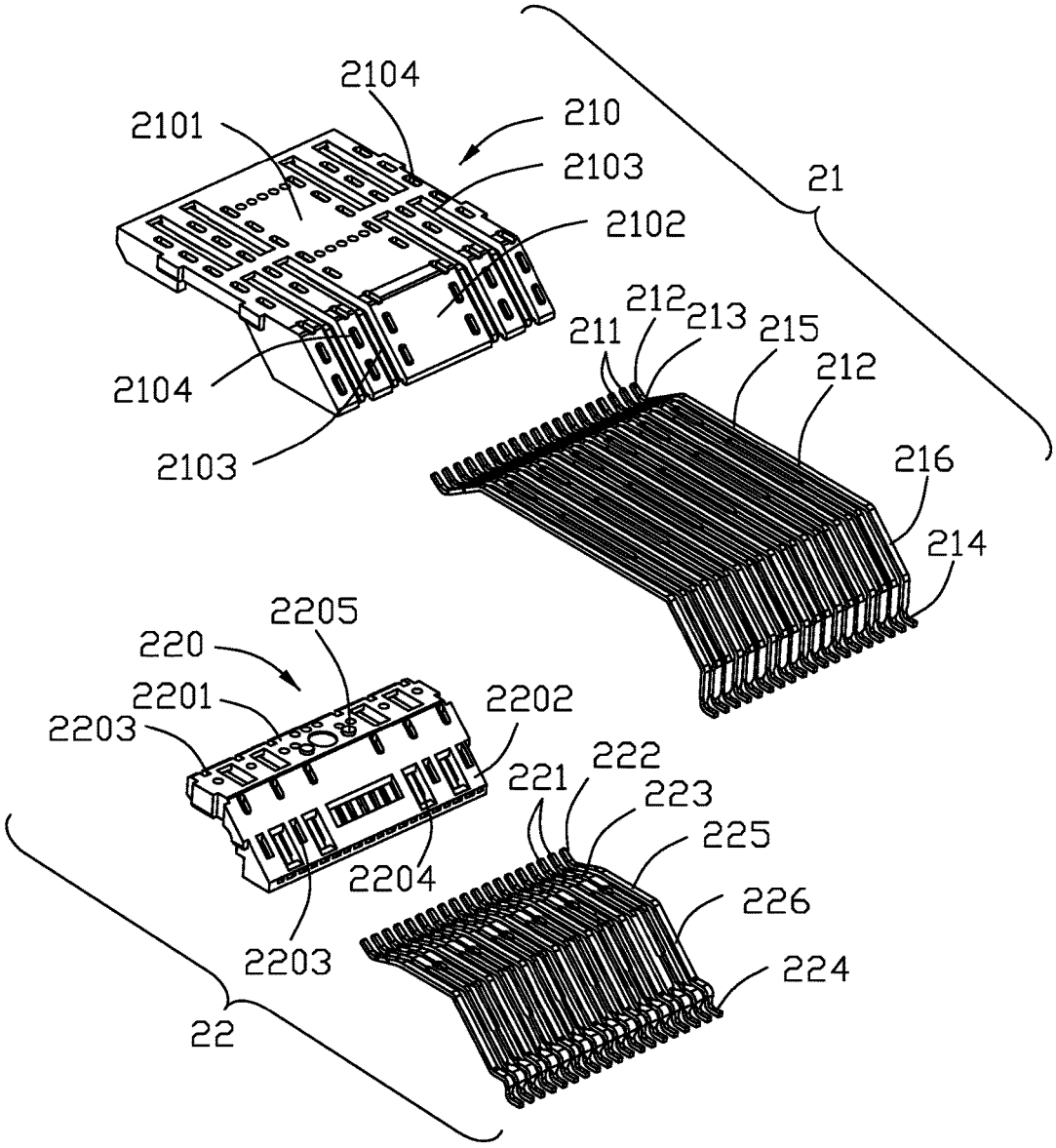
FIG. 9 is a further exploded view of a first module and a second module of the upper contact module of the electrical connector as shown in FIG. 7.
Figure 10:
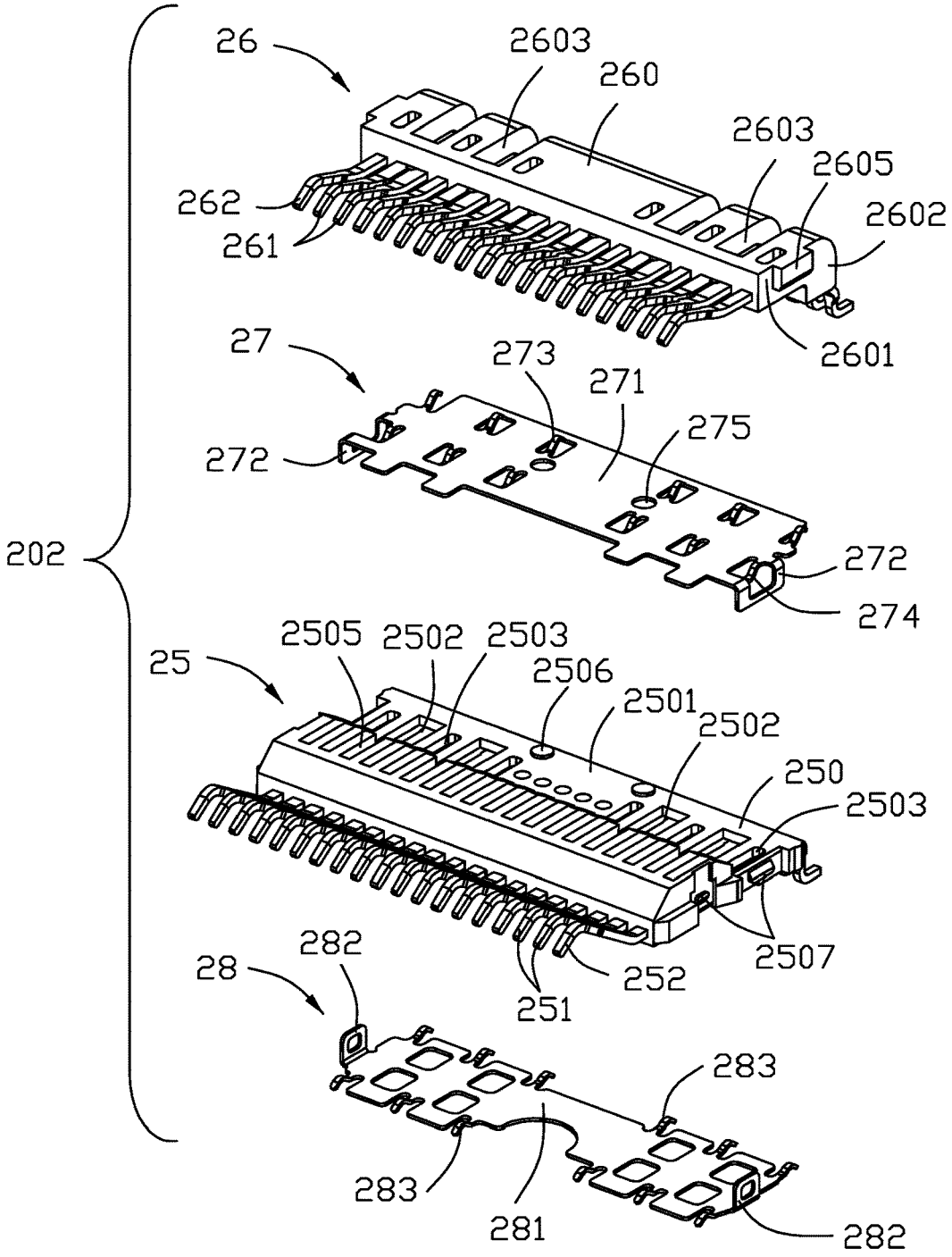
FIG. 10 is a further exploded view of a lower contact module of the electrical connector as shown in FIG. 6.
Figure 11:
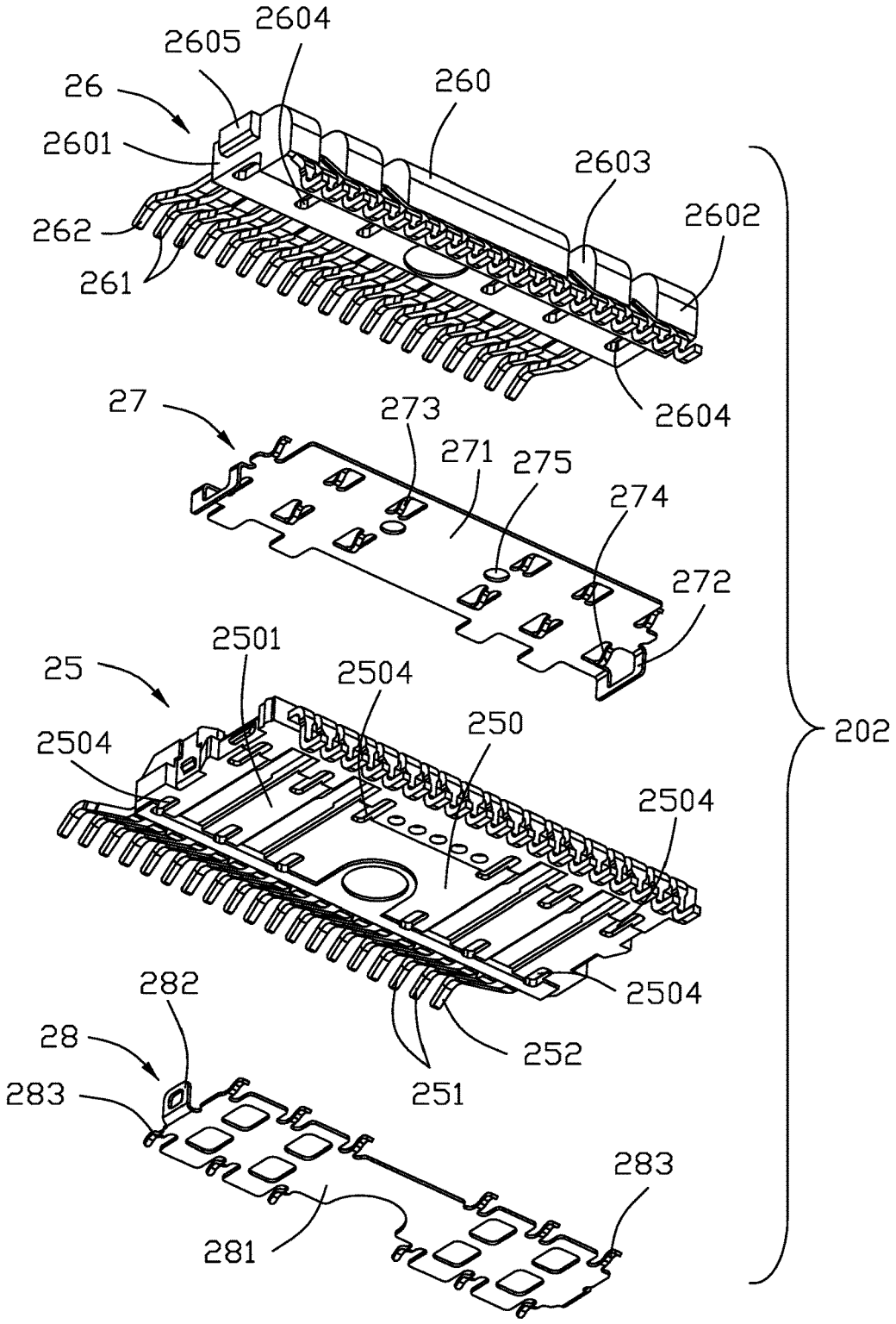
FIG. 11 is another further exploded view of the lower contact module of the electrical connector as shown in FIG. 10.
Figure 12:
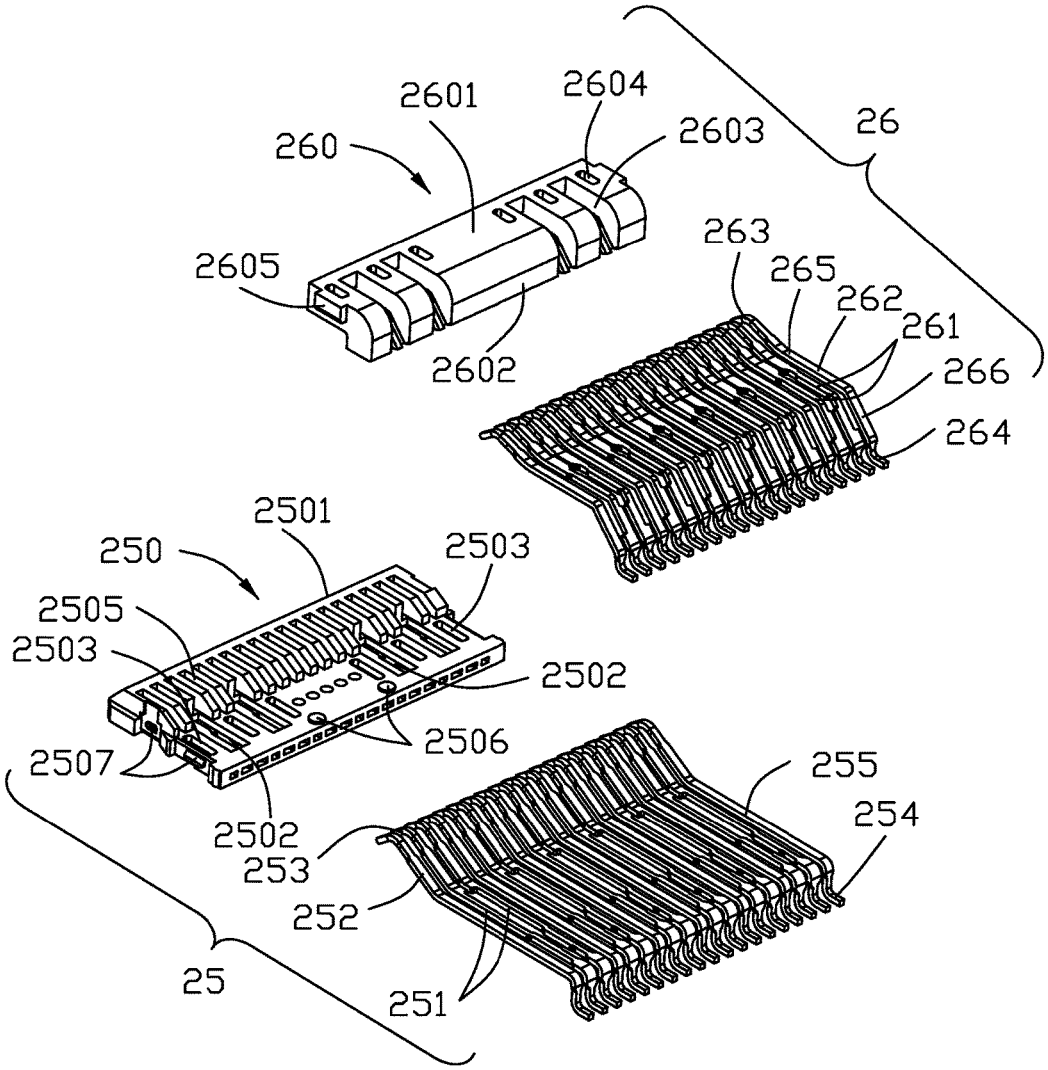
FIG. 12 is a further exploded view of a third module and a fourth module of the lower contact module of the electrical connector as shown in FIG. 9.
Figure 13:
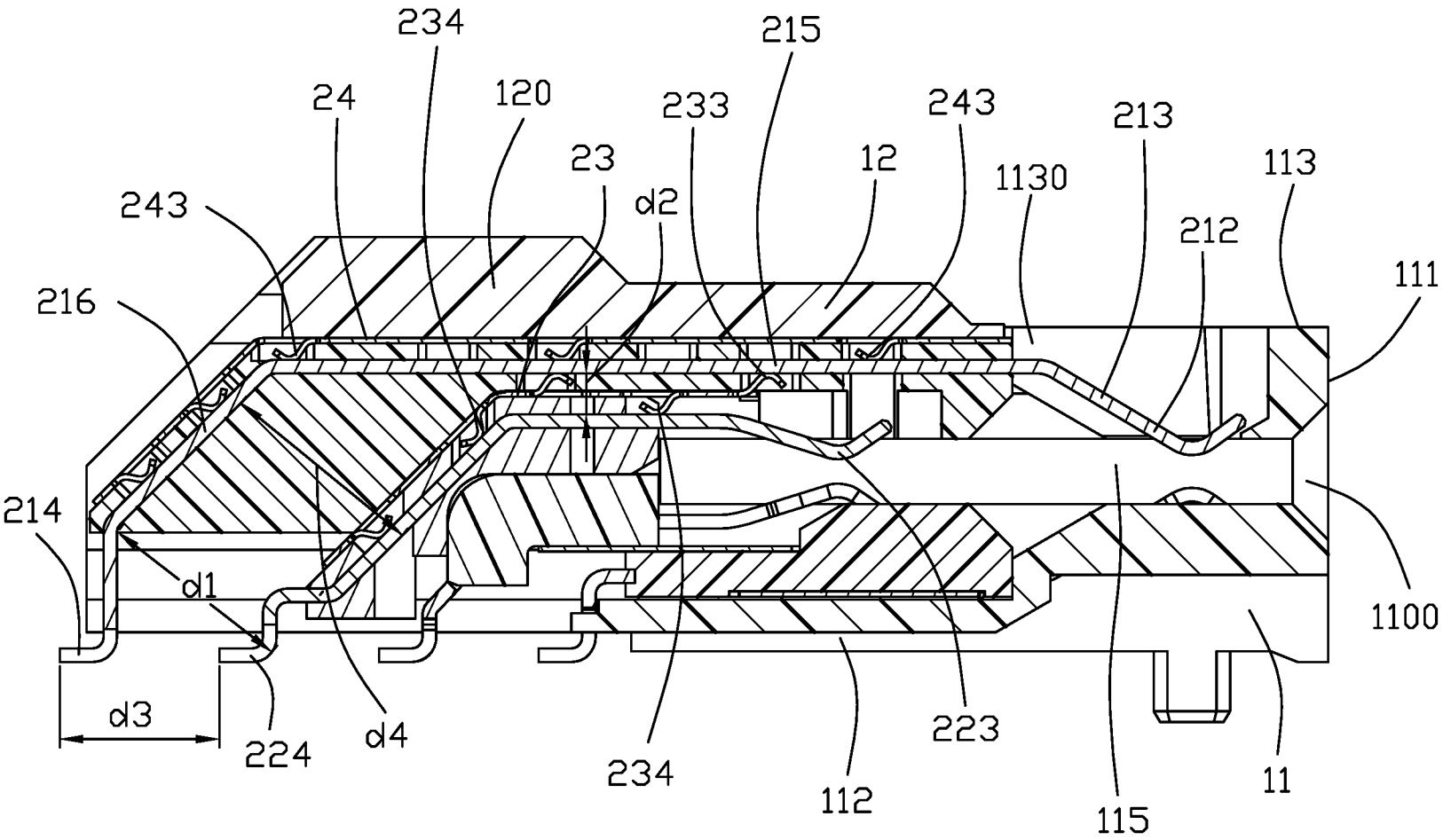
FIG. 13 is a cross-sectional view of the electrical connector taken along line 13-13 in FIG. 1.
Figure 14:
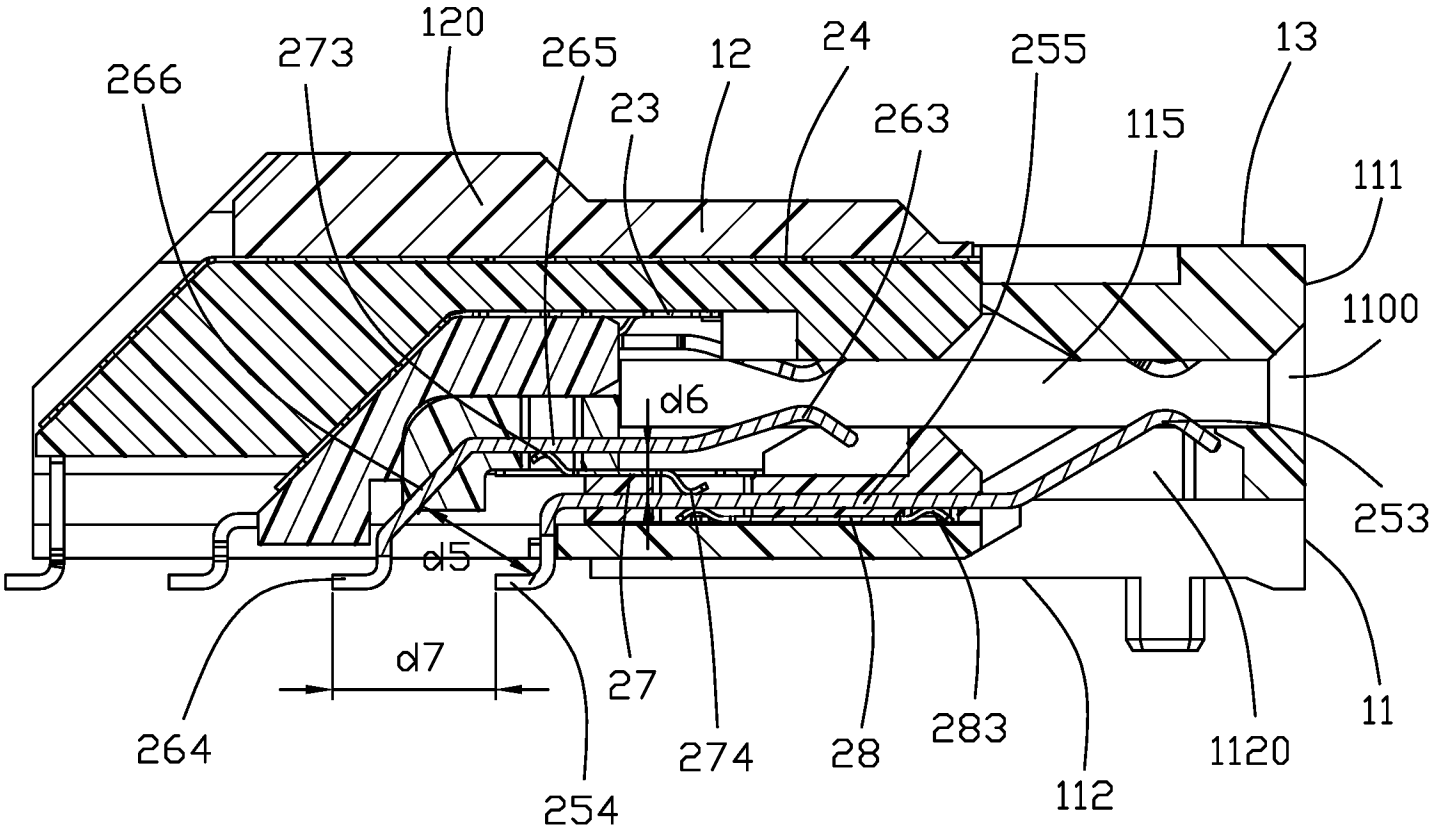
FIG. 14 is a cross-sectional view of the electrical connector taken along line 14-14 in FIG. 2.

Reference will now be made in detail to a preferred embodiment of the present invention.

Referring to FIGS. 1 to 14, an electrical connector 100 adapted for being mounted on a printed circuit board of an outer device and for being mated with a mating connector, comprises an insulative housing 1 and a contact module 2 received in the insulative housing 1.

Referring to FIGS. 1 to 6, 13 and 14, the insulative housing 1 comprises a main body 11 and a top cover 12 assembled with the main body 11. The main body 11 comprises a mating face 110, a mounting face 111 opposite to the mating face 110 for the contact module 2 assembled therein, a bottom wall 112 connected with the mating face 110 and the mounting face 111 for being mounted on the printed circuit board, a top wall 113 opposite to the bottom wall 112, a pair of side walls, and a receiving room 115. The mating face 110 defines a mating slot 1100 in communication with the receiving room 115 for the mating connector into the receiving room 115. The bottom wall 112 defines a plurality of lower through holes 1120 extending through the bottom wall 112 along vertical direction. The top wall 113 defines a plurality of upper through holes 1130 extending through the top wall 113 along the vertical direction. The pair of the side walls 114 extend rearwardly beyond the top wall 112 and the bottom wall 113 along rearward direction. Each of the side walls 114 defines a plurality of mounting slot 1140 in an inner side. The top cover 12 comprises a flat cover body 120 and a pair of mounting portions 121 formed at an opposite sides of the cover body 120, respectively. The mounting portions 121 are mated with the corresponding mounting slots 1140 to fix the top cover to the main body 11.

Referring to FIGS. 1 to 14, the contact module 2 comprises an upper contact module 201 and a lower contact 202 module disposed below the upper contact module 201. The upper contact module 201 comprises a first contact module 21, a second contact module 22 disposed below the first contact module 21, a first middle conductive member 23 disposed therebetween, and a first conductive member 24 disposed above the first contact module 21. The lower contact module 202 comprises a third contact module 25, a fourth contact module 26 disposed above the third contact module 25, a second middle conductive member 27 disposed therebetween, and a second conductive member 28 disposed udder the third contact module 25.

Referring to FIGS. 1 to 9 and 13, the first contact module 21 comprises a first insulative member 210, a plurality pairs of first signal contacts 211 fixed by the first insulative member 210 for transmitting high speed differential signals, a plurality of first grounding contacts 212 fixed by the first insulative member 210. The first grounding contacts 212 and the first signal contacts 211 are arranged in a first row, each of the pairs of first signal contacts 211 disposed between a pair of the first grounding contacts 212. In this embodiment, the first insulative member 210 is molding on the first signal contacts 211 and the first grounding contacts 212. The first insulative member 210 comprises a first portion 2101 extending along horizontal direction, and a second portion 2102 extending from a rear end of the first portion 2101 rearwardly and downwardly. The first insulative member 210 defines a plurality of opening 2103 corresponding with the first signal contacts 211 respectively to expose a portion of the corresponding first signal contacts 211 received in the first insulative member 210 to the air as much as possible to adjust the characteristic impedance of the first signal contacts 211. Therefore, the first signal contacts 211 can transmit a high speed signal. The first insulative member 210 defines a plurality of upper holes 2104 and lower holes 2105 aligned with the corresponding first grounding contacts 212. Each of the first grounding contacts 212 is aligned with at least two of upper holes 2104 and at least two lower holes 2015. The first insulative member 210 defines a plurality of first recesses 2106 in a bottom side. Each of the first grounding contacts 212 and the first signal contacts 211 comprises a first contact portion 213 for being mated with the mating connector, a first mounting portion 214 for being mounted on the printed circuit board, a first horizontal portion 215 extending horizontally from a rear end of the first contact portion 213, and a first connecting portion 216 connected with the first horizontal portion 215 and the first mounting portion 214. The first connecting portion 216 extends from the first horizontal portion 215 rearwardly and downwardly. The first contact portions 213 are received in the upper through holes 1130 of the top wall 113, respectively. The first mounting portions 214 can be mounted on the printed circuit board by surface mounted technology. The first horizontal portions 215 and the first connecting portions 216 are received in the first insulative member 210.

The second contact module 22 is similar to the first contact module 21, but a size of the second contact module 22 is smaller than the a size of first contact module 21. The second contact module 22 comprises a second insulative member 220, a plurality pairs of second signal contacts 221 fixed by the second insulative member 220 for transmitting high speed differential signals, a plurality of second grounding contacts 222 fixed by the second insulative member 220. The second grounding contacts 222 and the second signal contacts 221 are arranged in a second row, each of the pairs of second signal contacts 221 disposed between a pair of the second grounding contacts 222. In this embodiment, the second insulative member 220 is molding on the second signal contacts 221 and the second grounding contacts 222. The second insulative member 220 comprises a first portion 2201 extending along horizontal direction, and a second portion 2202 extending from a rear end of the first portion 2201 rearwardly and downwardly. The second insulative member 220 defines a plurality of opening 2203 corresponding with the second signal contacts 221 respectively to expose a portion of the corresponding second signal contacts 221 received in the first insulative member 210 to the air as much as possible to adjust the characteristic impedance of the second signal contacts 221. Therefore, the second signal contacts 221 can transmit a high speed signal. The second insulative member 220 defines a plurality of upper holes 2204 aligned with the corresponding second grounding contacts 222. Each of the second grounding contacts 222 is aligned with at least two of upper holes 2204. The second insulative member 220 comprises a pair of posts 2205 spaced apart with each other. Each of the second grounding contacts 222 and the second signal contacts 221 comprises a second contact portion 223 for being mated with the mating connector, a second mounting portion 224 for being mounted on the printed circuit board, a second horizontal portion 225 extending horizontally from a rear end of the second contact portion 223, and a second connecting portion 226 connected with the second horizontal portion 225 and the second mounting portion 224. The second connecting portion 226 extends from the second horizontal portion 225 rearwardly and downwardly. The second contact portions 223 are received in the first recesses 2106 of the first insulative member 210, respectively. The second mounting portions 224 can be mounted on the printed circuit board by surface mounted technology. The second horizontal portions 225 and the second connecting portions 226 are received in the second insulative member 220.

The first grounding contacts 212 and the first signal contacts 211 are aligned with the second grounding contacts 222 and the second signal contacts 221 along a vertical direction, respectively. The first contact portions 213 are disposed at a front of the second contact portions 223. The first contact portions 213 and the second contact portions 223 are mated with a same side of the mating connector. The first mounting portions 214 are disposed at a rear of the second mounting portions 224. The second connecting portions 226 are disposed parallel to the first connecting portions 216. A first distance d1 measured from the first connecting portions 216 to the second mounting portions 224 is greater than a second distance d2 measure from the first horizontal portions 215 to the second horizontal portions 225, and is also greater than a third distance d3 measure from the first mounting portions 214 to the second mounting portions 224. Further more, a fourth distance d4 measured from the first connecting portions 216 to the second connecting portions 226 is greater than the first distance d2, and is also greater than the third distance d3. Specifically, the first distance d1 is measured from the first connecting portions 216 to bending points of the surface mounting region of the second mounting portion 224 started to be bent into horizontal. In this embodiment, the first distance d1 is equal to or greater than 3.561 mm.

The first middle conductive member 23 is manufactured by metal sheet. The first middle conductive member 23 comprises a first portion 231 disposed horizontally, and a second portion 232 extending from a rear end of the first portion 231 rearwardly and downwardly. The first middle conductive member 23 comprises a plurality of upper spring members 233 extending toward the first contact module 21, a plurality of lower spring members 234 extending toward the second contact module 22, and a pair of mounting holes 235 spaced apart from each other. The first middle conductive member 23 is fixed on the second insulative member 220 by the pair of the mounting holes 235 mated with the pair of posts 2205 of the second insulative member 220. The upper spring members 233 extend through the lower holes 2105 of the first insulative member 210 to electrically connect with each of the first grounding contacts 212 in at least two different locations. The lower spring members 234 extend through the upper holes 2204 of the second insulative member 220 to electrically connect with each of the second grounding contacts 222 in at least two different locations.

The first conductive member 24 is manufactured by metal sheet. The first conductive member 24 is mounted on the first insulative member 210 at a side adjacent to the insulative housing 1. The first conductive member 24 comprises a first portion 241 disposed horizontally, and a second portion 242 extending from a rear end of the first portion 241 rearwardly and downwardly. The first conductive member 24 comprises a plurality of spring members 243 extending toward the first contact module 21. The spring members 243 extend through the upper holes 2104 of the first insulative member 210 to electrically connect with each of the first grounding contacts 212 in at least two different locations.

Referring to FIGS. 1 to 6, 10-12 and 14, the third contact module 25 comprises a third insulative member 250, a plurality pairs of third signal contacts 251 fixed by the third insulative member 250 for transmitting high speed differential signals, a plurality of third grounding contacts 252 fixed by the third insulative member 250. The second contact module 22 is disposed between the first contact module 21 and the third contact module 25. The third grounding contacts 252 and the third signal contacts 251 are arranged in a third row, each of the pairs of third signal contacts 251 disposed between a pair of the third grounding contacts 252. In this embodiment, the third insulative member 250 is molding on the third signal contacts 251 and the third grounding contacts 252. The third insulative member 250 comprises a main portion 2501 extending along horizontal direction. The main portion 2501 defines a plurality of opening 2502 aligned with the corresponding third signal contacts 251 respectively to expose a portion of the third signal contacts 251 received in the third insulative member 250 to the air as much as possible to adjust the characteristic impedance of the third signal contacts 251. Therefore, the third signal contacts 251 can transmit a high speed signal. The main portion 2501 defines a plurality of upper holes 2503 and lower holes 2504 aligned with the corresponding third grounding contacts 252. Each of the third grounding contacts 252 is aligned with at least one of upper holes 2503 and at least two lower holes 2504. The main portion 2501 defines a plurality of second recesses 2505 in a top side, a pair of posts 2506 disposed at a rear side of the second recesses 2505, and a pair of latch block 2507 disposed at two opposite sides respectively. Each of the third grounding contacts 252 and the third signal contacts 251 comprises a third contact portion 253 for being mated with the mating connector, a third mounting portion 254 for being mounted on the printed circuit board, and a third horizontal portion 255 extending horizontally from a rear end of the third contact portion 253. The third contact portions 253 are received in the lower through holes 1120 of the bottom wall 112, respectively. The third mounting portions 254 can be mounted on the printed circuit board by surface mounted technology. The third horizontal portions 255 are received in the third insulative member 250.

The fourth contact module 26 is similar to the third contact module 25. The fourth contact module 26 comprises a fourth insulative member 260, a plurality pairs of fourth signal contacts 261 fixed by the fourth insulative member 260 for transmitting high speed differential signals, a plurality of fourth grounding contacts 262 fixed by the fourth insulative member 260. The fourth grounding contacts 262 and the fourth signal contacts 261 are arranged in a fourth row spaced apart from the third row along vertical direction, each of the pairs of fourth signal contacts 261 disposed between a pair of the fourth grounding contacts 262. In this embodiment, the fourth insulative member 260 is molding on the fourth signal contacts 261 and the fourth grounding contacts 262. The fourth insulative member 260 comprises a first portion 2601 extending along horizontal direction, and a second portion 2602 extending from a rear end of the first portion 2601 rearwardly and downwardly. The fourth insulative member 260 defines a plurality of opening 2603 corresponding with the fourth signal contacts 261 respectively to expose a portion of the corresponding fourth signal contacts 261 received in the fourth insulative member 260 to the air as much as possible to adjust the characteristic impedance of the fourth signal contacts 261. Therefore, the fourth signal contacts 261 can transmit a high speed signal. The fourth insulative member 260 defines a plurality of lower holes 2604 aligned with the corresponding fourth grounding contacts 262. Each of the fourth grounding contacts 262 is aligned with at least one of lower holes 2604. The first portion 2601 of the fourth insulative member 260 comprises latch block 2605 disposed at two opposite sides respectively. Each of the fourth grounding contacts 262 and the fourth signal contacts 261 comprises a fourth contact portion 263 for being mated with the mating connector, a fourth mounting portion 264 for being mounted on the printed circuit board, a fourth horizontal portion 265 extending horizontally from a rear end of the fourth contact portion 263, and a fourth connecting portion 266 connected with the fourth horizontal portion 265 and the fourth mounting portion 264. The fourth connecting portion 266 extends from the fourth horizontal portion 265 rearwardly and downwardly. The fourth contact portions 263 are received in the second recesses 2505 of the third insulative member 250, respectively. The fourth mounting portions 264 can be mounted on the printed circuit board by surface mounted technology. The fourth horizontal portions 265 and the fourth connecting portions 266 are received in the fourth insulative member 260.

The third grounding contacts 252 and the third signal contacts 251 are aligned with the fourth grounding contacts 262 and the fourth signal contacts 261 along a vertical direction, respectively. The first grounding contacts 212 and the first signal contacts 211 are offset with the third grounding contacts 252 and the third signal contacts 251 respectively along a right to left direction. The third contact portions 253 are disposed at a front of the fourth contact portions 263. The third contact portions 253 and the fourth contact portions 263 are mated with the other same side of the mating connector. The first contact portions 213 and the third contact portions 253 can be used to be mated with a standard QSFP plug. The first contact portions 213, the second contact portions 223, the third contact portions 253, and the fourth contacts portions 263 can be used to be mated with a standard QSFP-DD plug. The fourth mounting portions 264 are disposed at a rear of the third mounting portions 254, and at a front of the second mounting portions 224. A fifth distance d5 measured from the fourth connecting portions 266 to the third mounting portions 254 is greater than a sixth distance d6 measure from the third horizontal portions 255 to the fourth horizontal portions 265, and is also greater than a seventh distance d7 measure from the third mounting portions 254 to the fourth mounting portions 264. Specifically, the fifth distance d5 is measured from the fourth connecting portions 266 to bending points of the surface mounting region of the third mounting portion 254 started to be bent into horizontal. In this embodiment, the fifth distance d5 is equal to or greater than 2.449 mm.

The second middle conductive member 27 is manufactured by metal sheet. The second middle conductive member 27 comprises a main portion 271 disposed horizontally, and a pair of latch beams 272 extending downwardly from opposite sides of the main portion 271, respectively. The main portion 271 comprises a plurality of upper spring members 273 extending toward the fourth contact module 26, a plurality of lower spring members 274 extending toward the third contact module 25, and a pair of mounting holes 275 spaced apart from each other. The second middle conductive member 27 is mounted on the third insulative member 250 by the pair of the mounting holes 275 mated with the pair of posts 2506 of the third insulative member 250, and fixed to the third insulative member 250 by the latch 273 latched with the latch block 2507 of the third insulative member 250. The upper spring members 273 extend through the lower holes 2604 of the fourth insulative member 260 to electrically connect with each of the fourth grounding contacts 262. The lower spring members 274 extend through the upper holes 2503 of the third insulative member 250 to electrically connect with each of the third grounding contacts 252.

The second conductive member 28 is manufactured by metal sheet. The second conductive member 28 is mounted on the third insulative member 250 at a side adjacent to the insulative housing 1. The second conductive member 28 comprises a main portion 281 disposed horizontally, and a pair of latch beams 282 extending downwardly from opposite sides of the main portion 281, respectively. The second conductive member 28 is fixed on the third insulative member 250 by the latch beams 282 latched with the latch block 2507. The second conductive member 28 comprises a plurality of spring members 283 extending toward the third contact module 25. The spring members 283 extend through the lower holes 2504 of the third insulative member 250 to electrically connect with each of the third grounding contacts 252 in at least two different locations.

Figure 15:
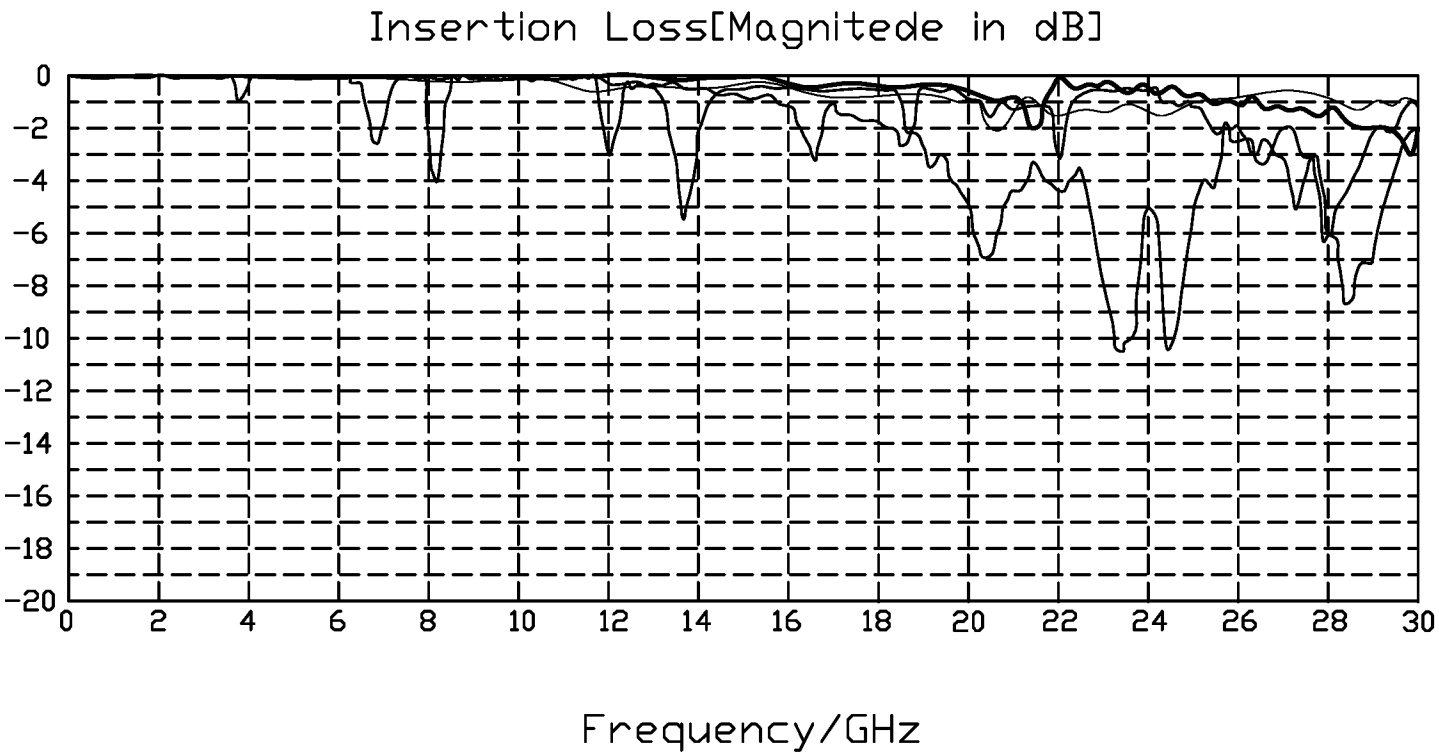
FIG. 15 is a relationship chart between insertion loss and frequency of the electrical connector in accordance with present invention, with a first conductive member, a second conductive member, a first middle conductive member, and a second conductive member not been assembled, and with a structure of the contacts not been adjusted.

FIG. 15 is a relationship chart between insertion loss and frequency of an electrical connector, with the first conductive member 24, the second conductive member 28, the first middle conductive member 23, and the second conductive member 27 not been assembled, and with a structure of the contacts not been adjusted. The specification required that the insertion loss of the electrical connector should be greater than −1 dB in the range of 0-14 GHz. As can be seen from the relationship chart, the insertion loss of the electrical connector is smaller than −1 dB at 4 GHz, 7 GHz, 8 GHz, 12 GHz, and 13.5 GHz. The main reason for this phenomenon is that resonance occurs in those frequencies, thereby impairing the transmission of high speed signals, so that the rate of high speed signals cannot reach 28 Gbps.

Figure 16:
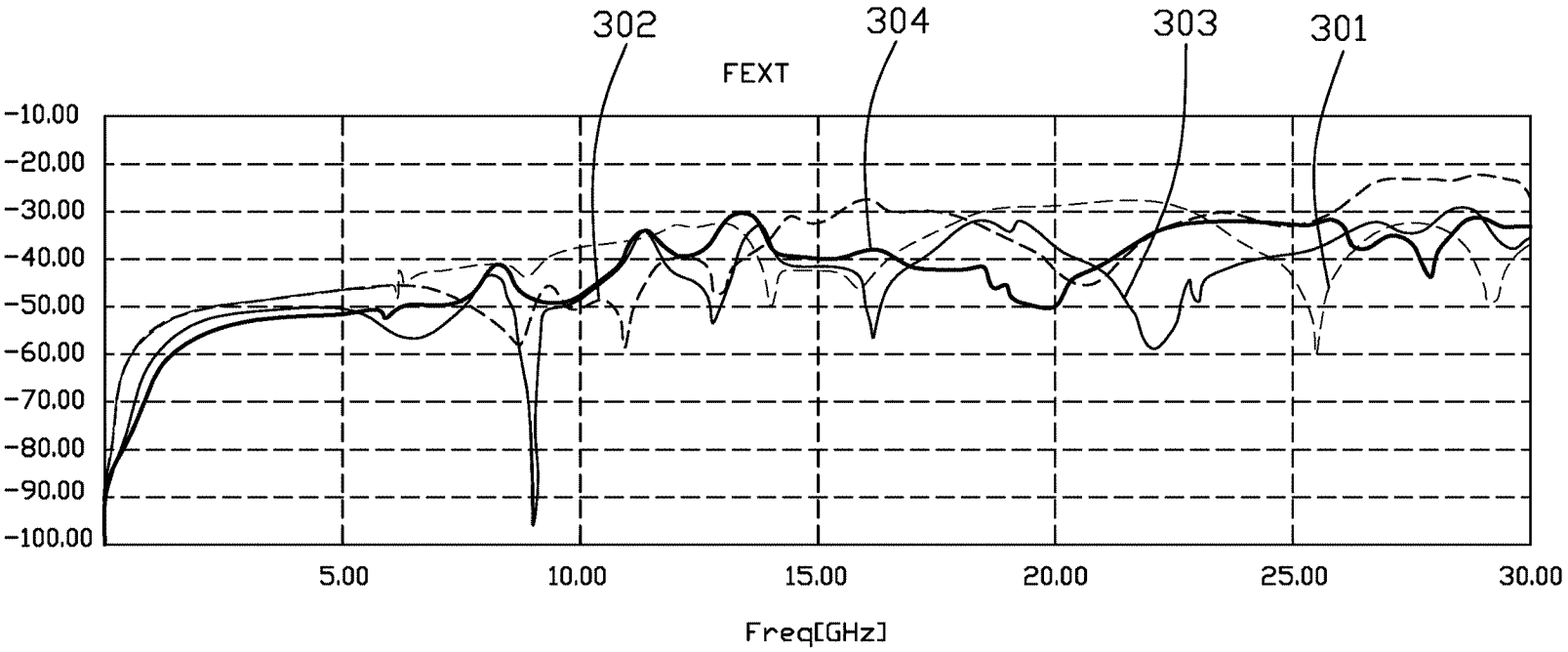
FIG. 16 is a relationship chart between far end crosstalk and frequency of the electrical connector in accordance with present invention, before and after a structure of contacts adjusted of an upper contact module.

FIG. 16 is a relationship chart between far end crosstalk and frequency of the electrical connector 100, before and after a structure of contacts adjusted of an upper contact module 201. The specification required that the far end crosstalk value is as small as possible, in the range of 0-14 GHz. The curve of reference numeral 301 shows a relationship between the far end crosstalk and the frequency of the first contact module 21 before the adjustment of the structures of the first signal contacts 211 and the first grounding contacts 212. The curve of reference numeral 303 shows a relationship between the far end crosstalk and the frequency of the first contact module 21 after the adjustment of the structures of the first signal contacts 211 and the first grounding contacts 212. The curve of reference numeral 302 shows a relationship between the far end crosstalk and the frequency of the second contact module 22 before the adjustment of the structures of the second signal contacts 221 and the second grounding contacts 222. The curve of reference numeral 304 shows a relationship between the far end crosstalk and the frequency of the second contact module 22 after the adjustment of the structures of the second signal contacts 221 and the second grounding contacts 222.

Figure 17:
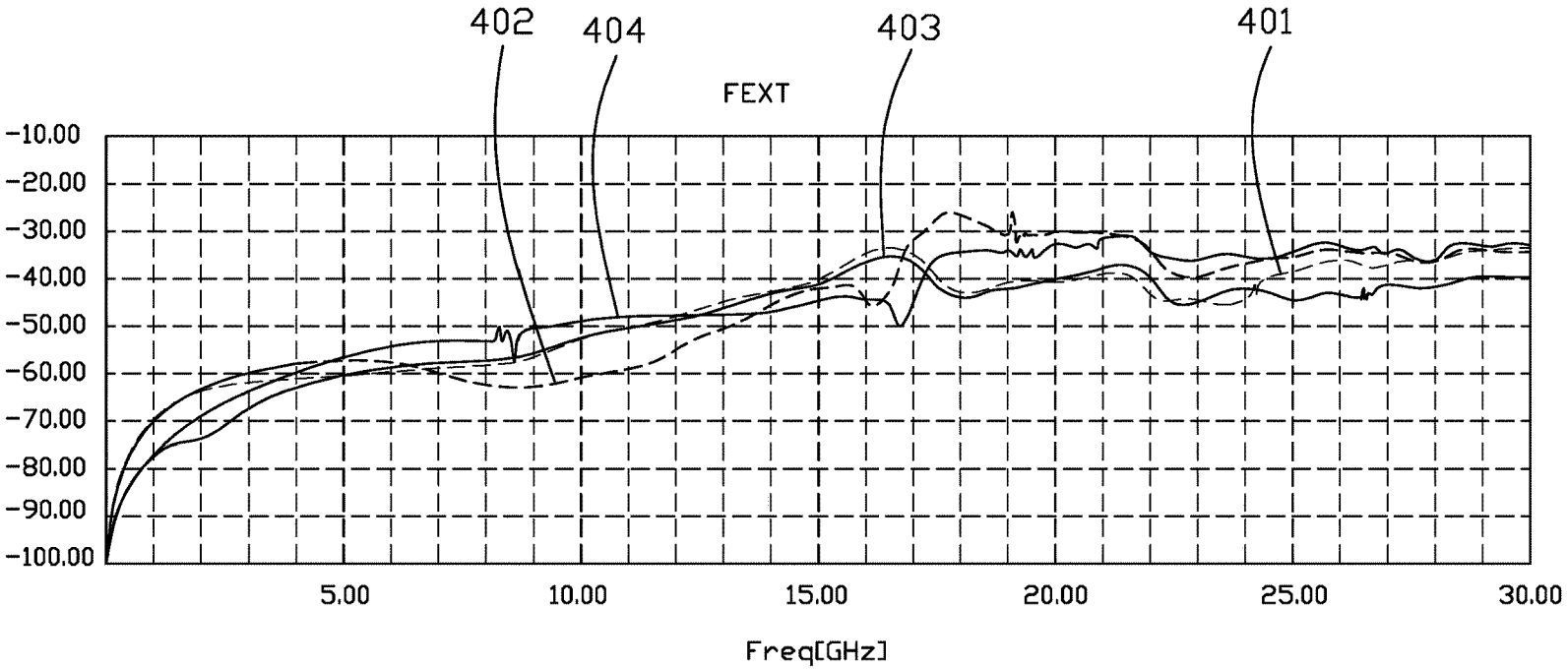
FIG. 17 is a relationship chart between far end crosstalk and frequency of the electrical connector in accordance with present invention, before and after a structure of contacts adjusted of a lower contact module.

FIG. 17 is a relationship chart between far end crosstalk and frequency of the electrical connector 100, before and after a structure of contacts adjusted of a lower contact module 202. The specification required that the far end crosstalk is as small as possible, in the range of 0-14 GHz. The curve of reference numeral 401 shows a relationship between the far end crosstalk and the frequency of the third contact module 25 before the adjustment of the structures of the third signal contacts 251 and the third grounding contacts 252. The curve of reference numeral 403 shows a relationship between the far end crosstalk and the frequency of the third contact module 23 after the adjustment of the structures of the third signal contacts 251 and the third grounding contacts 252. The curve of reference numeral 402 shows a relationship between the far end crosstalk and the frequency of the fourth contact module 26 before the adjustment of the structures of the fourth signal contacts 261 and the fourth grounding contacts 262. The curve of reference numeral 404 shows a relationship between the far end crosstalk and the frequency of the fourth contact module 26 after the adjustment of the structures of the fourth signal contacts 261 and the fourth grounding contacts 262.

Figure 18:
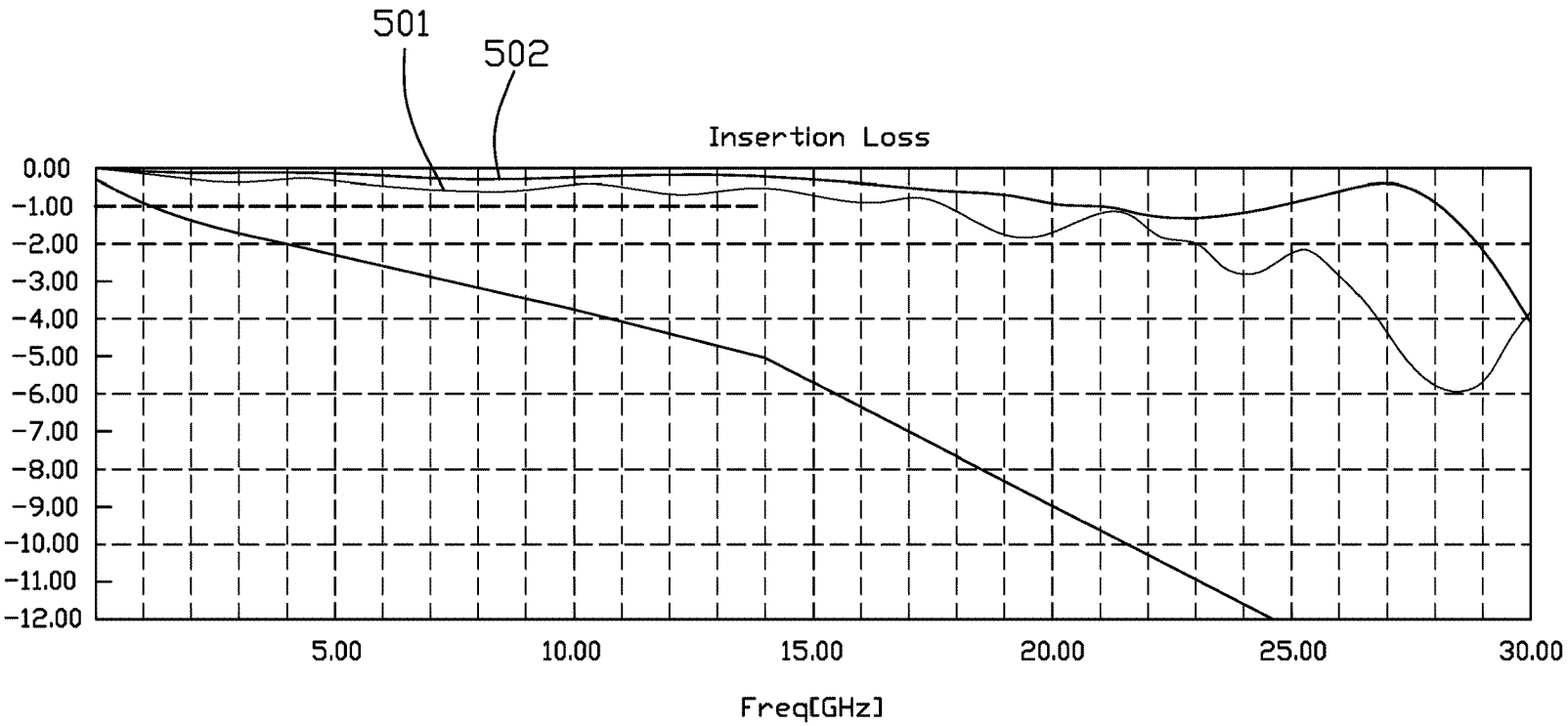
FIG. 18 is a relationship chart between insertion loss and frequency of the upper contact module of the electrical connector in accordance with present invention.

FIG. 18 is a relationship chart between insertion loss and frequency of the upper contact module 201 of the electrical connector 100. The curve of reference numeral 501 shows a relationship between the insertion loss and frequency of the first contact module 21. The curve of reference numeral 502 shows a relationship between the insertion loss and frequency of the second contact module 22. As can be seen from the relationship chart, the insertion loss of the electrical connector is greater than −1 dB, in the frequency range of 0-14 GHz required by the specification or even higher.

Figure 19:
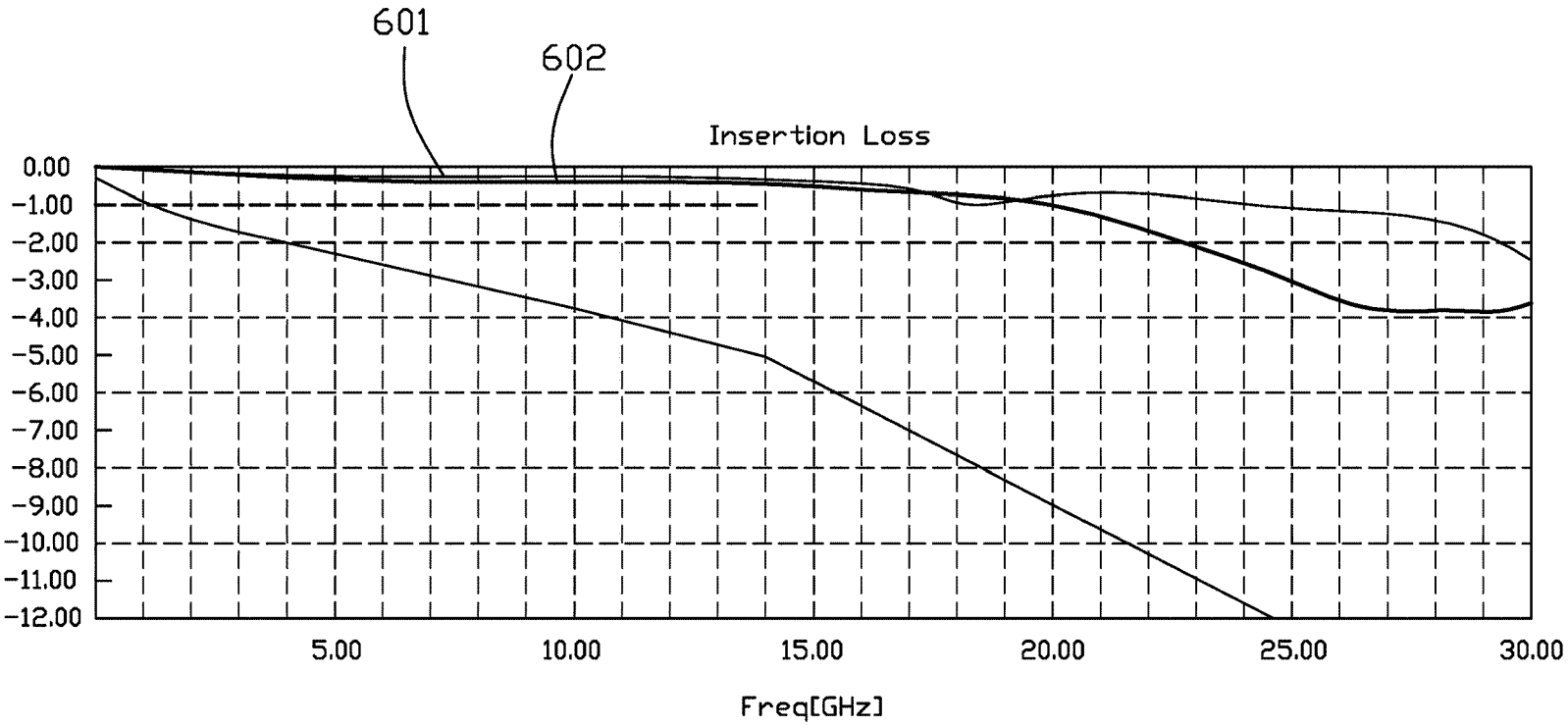
FIG. 19 is a relationship chart between insertion loss and frequency of the lower contact module of the electrical connector in accordance with present invention.

FIG. 19 is a relationship chart between insertion loss and frequency of the lower contact 202 module of the electrical connector 100. The curve of reference numeral 601 shows a relationship between the insertion loss and frequency of the third contact module 25. The curve of reference numeral 602 shows a relationship between the insertion loss and frequency of the fourth contact module 26. As can be seen from the relationship chart, the insertion loss of the electrical connector is greater than −1 dB, in the frequency range of 0-14 GHz required by the specification or even higher.

In this embodiment. the electrical connector 100 conforms to the QSFP-DD specification, which defines eight high speed transmitter signal transmission channels and eight high speed receiver signal transmission channels, each of which has a signal transmission rate of 28 Gbps or more and a signal frequency of 14 GHz. Of course, the present invention can also be applied to high speed electrical connectors that are being developed, such as SFP-DD or the like, or other undefined sets of the same or different number of channels or that transmit higher speeds. In this embodiment, both the first contacts and the third contacts are the outer contacts, and both the second contacts and the fourth contacts are the inner contacts wherein the contacting/mating point (not labeled) of the outer contact is located in front of that of the inner contact. In this embodiment both the first contacts and the second contacts are of the upper contacts having the corresponding contacting/mating points on an upper side of the receiving room, and both the third contacts and the fourth contacts are of the lower contacts have the corresponding contacting/mating points on a lower side of the receiving room. In this embodiment, the upper outer contact, i.e., the first contact, is longest and the lower inner contact, i.e., the fourth contact, is shortest. As noted, the longer the contact is, the more resonant the contact is. To solve the resonance problem, in this invention the first contact is provided with two conductive members 23, 24 by two sides thereof and five plus two grounding locations at opposite surfaces of the corresponding first grounding contact. In opposite, the fourth contact is only provided with one conductive member and one grounding location on one surface of the corresponding fourth grounding contact. In addition, in an overall viewpoint, the insulative members of the contact modules and the insulative housing commonly form the insulative housing body retaining the corresponding contacts therein for the whole connector. The reason why there are four contact modules with different insulative members is to ease arrangement of the contacts and the conductive members. As mentioned before, the spirit of the invention is to adjust/enlarge the related distance between the neighboring rows of the contacts. For example, the horizontal first mounting portion 214 is equipped with a vertical portion (not labeled) to connect to the corresponding oblique first connecting portion 216, and the second mounting portion 224 is as well. Understandably, it is improper to directly link the horizontally extending mounting portion 214 to the obliquely extending connecting portion 216 because of solder contamination and stiffness issues. To enlarge the distance d4, the obliquely extending second connecting portion 226 is intentionally forwardly moved with a distance in a translational way, thus result in an additional vertical portion (not labeled) between the obliquely extending second connecting portion 226 and the vertical portion (not labeled) which is equipped upon the horizontally extending second mounting portion 224. In an overall viewpoint, the key issue is to have the first mounting portion, the second mounting portion, the third mounting portion and the fourth mounting portion are spaced from one another with an equal distance in a side view while to enlarge the distance between the obliquely extending first connecting portion and the obliquely extending second connecting portion because the first contact being the longest one than others tends to own more resonance than others.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing; and a plurality of contacts received in the insulative housing, the contacts comprising a pair of first grounding contacts for transmitting grounding signal, a pair of first signal contacts for transmitting a differential signal, a pair of second grounding contacts for transmitting grounding signal, and a pair of second signal contacts for transmitting a differential signal, the first grounding contacts and the first signal contacts arranged in a first row along a first direction, the first signal contacts disposed between the first grounding contacts, the second grounding contacts and the second signal contacts arranged in a second row along the first direction, the second signal contacts disposed between the second grounding contacts, the second row is spaced apart from the first row along a second direction perpendicular to the first direction, each of the first signal contacts and the first grounding contacts comprising a first contact portion for being mated with a plug connector, a first mounting portion for being mounted on an outer printed circuit board, a first horizontal portion extending rearwardlly from the first mating portion, and a first connecting portion connected between the first horizontal portion and the first mounting portion, each of the second signal contacts and the second grounding contacts comprising a second contact portion for being mated with the plug connector, a second mounting portion for being mounted on the outer printed circuit board, and a second horizontal portion extending rearwardlly from the second mating portion; wherein a first distance between the first connecting portion and the second mounting portion is greater than a second distance between the first horizontal portion and the second horizontal portion, and is also greater than a third distance between the first mounting portion and the second mounting portion.

2. The electrical connector as recited in claim 1, wherein each of the second signal contacts and the second grounding contacts comprises a second connecting portion connected between the second horizontal portion and the second mounting portion, a fourth distance between the first connecting portion and the second connecting portion greater than the second distance, and also greater than the third distance.

3. The electrical connector as recited in claim 2, wherein the first connecting portion extends rearwardly and downwardly from the first horizontal portion, and the second connecting portion extends rearwardly and downwardly form the second horizontal portion.

4. The electrical connector as recited in claim 3, wherein the second connecting portion is parallel to the first connecting portion.

5. The electrical connector as recited in claim 1, wherein the first mating portions are disposed at a front of the second mating portions, and the first mounting portions are disposed at a rear of the second mounting portions.

6. The electrical connector as recited in claim 1, wherein the contacts comprises a pair of third grounding contacts for transmitting grounding signal, a pair of third signal contacts for transmitting a differential signal, a pair of fourth grounding contacts for transmitting grounding signal, and a pair of fourth signal contacts for transmitting a differential signal, the third grounding contacts and the third signal contacts arranged in a third row along a third direction parallel to the first direction, the third signal contacts disposed between the third grounding contacts, the fourth grounding contacts and the fourth signal contacts arranged in a fourth row along the third direction, the fourth signal contacts disposed between the fourth grounding contacts, the fourth row is spaced apart from the third row along a fourth direction perpendicular to the third direction, each of the third signal contacts and the third grounding contacts comprising a third contact portion for being mated with the plug connector, a third mounting portion for being mounted on the outer printed circuit board, and a third horizontal portion extending rearwardlly from the third mating portion to connect with the third mounting portion, each of the fourth signal contacts and the fourth grounding contacts comprising a fourth contact portion for being mated with the plug connector, a fourth mounting portion for being mounted on the outer printed circuit board, a fourth horizontal portion extending rearwardlly from the fourth mating portion, and a connecting portion connected between the fourth horizontal portion and the fourth mounting portion, a fifth distance between the connecting portion and the third mounting portion greater than a sixth direction between the fourth horizontal portion and the third horizontal portion, and also greater than a seven distance between the fourth mounting direction and the third mounting direction.

7. The electrical connector as recited in claim 6, wherein the connecting portion extends rearwardly and downwardly from the fourth horizontal portion.

8. The electrical connector as recited in claim 6, wherein the third mating portions are disposed at a front of the fourth mating portions, the third mounting portions disposed at a front of the fourth mounting portions, the fourth mounting portions disposed at a front of the second mounting portions.

9. The electrical connector as recited in claim 6, wherein the first signal contacts and the first grounding contacts are arranged aligned with the second signal contacts and the second grounding contacts, respectively, the third signal contacts and the third grounding contacts are arranged aligned with the fourth signal contacts and the fourth grounding contacts, respectively.

10. The electrical connector as recited in claim 9, wherein the first signal contacts and the first grounding contacts are arranged offset with the third signal contacts and the third grounding contacts along a left to right direction, respectively.

11. The electrical connector as recited in claim 6, further comprising a first insulative member, a second insulative member, a third insulative member, and a fourth insulative member, the first signal contacts and the first grounding contacts fixed in the first insulative member to form a first contact module, the second signal contacts and the second grounding contacts fixed in the second insulative member to form a second contact module, the third signal contacts and the third grounding contacts fixed in the first insulative member to form a third contact module, the fourth signal contacts and the fourth grounding contacts fixed in the fourth insulative member to form a fourth contact module.

12. An electrical connector comprising:

an insulative housing body forming a receiving room exposed to an exterior in a horizontal direction for receive a mating connector;

four rows of contacts retained in the housing body including a row of upper outer contacts, a row of upper inner contacts, a row of lower outer contacts and a row of lower inner contacts where the upper outer contacts and the lower outer contacts have corresponding contacting points located in front of those of the upper inner contacts and the lower inner contacts, and the upper outer contacts and the upper inner contacts have the corresponding contacting points on an upper side of the receiving room while the lower outer contacts and the lower inner contacts have the corresponding contacting points on a lower side of the receiving room;

each of the four rows of contacts except the row of lower outer contacts including a deflectable contact portion exposed in the receiving room, a horizontally extending mounting portion exposed outside of the housing body, a horizontal portion connected to a rear end of the contact portion, an obliquely extending connecting portion linked to a rear end of the horizontal portion, and a vertical portion between the mounting portion and the connecting portion; wherein each contact of the upper inner row of contacts further includes a horizontal portion linked between the vertical portion and the obliquely extending connecting portion so as to enlarge a distance between the obliquely extending connecting portion of each of the upper outer row of contacts and that of each of the upper inner row of contacts.

13. The electrical connector as claimed in claim 12, wherein in a side view, the mounting portions of said four rows of contacts are spaced from one another with essentially an equal distance.

14. The electrical connector as claimed in claim 13, wherein the distance between the obliquely extending connecting portion of each of the upper outer row of contacts and that of each of the upper inner row of contacts is larger than that between the mounting portions of the neighboring rows of contacts in the side view.

15. The electrical connector as claimed in claim 13, wherein the distance between the mounting portions of the neighboring contacts of the neighboring rows is measured with corresponding free ends rather than a gap therebetween.

16. The electrical connector as claimed in claim 13, wherein a distance measured between the obliquely extending connecting portion of each contact of the lower inner row of contacts and a joint between the vertical portion and the mounting portion of each contact of the lower outer row of contacts, is smaller than the distance between the neighboring mounting portions of the neighboring contacts of the neighboring rows in the side view.

17. The electrical connector as claimed in claim 13, wherein a distance measured between the obliquely extending connecting portion of each contact of the lower inner row of contacts and a joint between the vertical portion and the mounting portion of each contact of the lower outer row of contacts, is larger than the distance between the neighboring mounting portions of the neighboring contacts of the neighboring rows in the side view, wherein the distance between the mounting portions of the neighboring contacts of the neighboring rows is measured with a gap therebetween.

* * * * *